US007191766B1

(12) United States Patent
Gregory Lee et al.

(10) Patent No.: US 7,191,766 B1
(45) Date of Patent: Mar. 20, 2007

(54) METHODS OF RETARDING INJECTION TIMING OF MECHANICAL UNIT INJECTORS USING A MODIFIED PUMP FOLLOWER

(75) Inventors: Schultz Gregory Lee, Naples, FL (US); Ed A. Schlairet, Naples, FL (US); Edward H. Harrison, Goodland, FL (US)

(73) Assignee: Haynes Corporation, Naples, FL (US)

( * ) Notice: Subject to any disclaimer, the term of this patent is extended or adjusted under 35 U.S.C. 154(b) by 0 days.

(21) Appl. No.: 11/397,411

(22) Filed: Apr. 4, 2006

(51) Int. Cl.
*F02M 37/06* (2006.01)
*F02M 37/04* (2006.01)

(52) U.S. Cl. ..... 123/501; 123/500

(58) Field of Classification Search ..... 123/500, 123/501, 503, 504, 507, 508; 239/88–92
See application file for complete search history.

(56) References Cited

U.S. PATENT DOCUMENTS 2,898,051 A 8/1959 Teichert
3,982,693 A 9/1976 Hulsing
4,054,248 A 10/1977 Beardmore
4,213,564 A 7/1980 Hulsing
4,317,541 A 3/1982 Beardmore
4,984,738 A 1/1991 Winquist
5,328,094 A 7/1994 Goetzke et al.
5,809,954 A * 9/1998 Devine et al. ..... 123/90.17
6,321,723 B1 11/2001 Merkle et al.
6,439,204 B1 8/2002 Duquette
6,763,810 B1 7/2004 Jones
6,799,561 B2 * 10/2004 Stewart et al. ..... 123/500

* cited by examiner

*Primary Examiner*—Mahmoud Gimie
(74) *Attorney, Agent, or Firm*—The Livingston Firm; Edward M. Livingston; Angela M. Miller

(57) ABSTRACT

A modified pump follower device (2) and method of retarding injection timing of EMD-type unit injectors by a desired amount of crank degrees includes the steps of providing a modified pump follower (2) whose plunger engagement location, also known as t-slot (7), varies depending on the desired amount of retarding. Specifically, the modified pump follower (2) has a t-slot (7) which has a predetermined distance t' on the modified pump follower (2), as compared to conventional pump followers having a predetermined distance t, such that the t-slot (14) is closer to the top face (9) of the pump follower (2). The difference in spacing between the original timing t and the retarded timing t' is r, which is an amount equal to the amount of retardation, in linear units, that corresponds to the desired amount of retardation in crank degrees.

8 Claims, 2 Drawing Sheets

METHODS OF RETARDING INJECTION TIMING OF MECHANICAL UNIT INJECTORS USING A MODIFIED PUMP FOLLOWER

BACKGROUND OF THE INVENTION

This invention relates to fuel injectors, more particularly, a modified pump follower for use in retarding injection timing of EMD-type unit injectors in diesel engines.

EMD-type unit injectors are injectors that feature mechanical unit injectors (as opposed to electronic control) and are widely used in the diesel engine industry, including the locomotive industry. However, with the increase of concern of harmful emissions from diesel engines and overall energy conservation, modifications to EMD-type unit injectors have become necessary so as to be more environmental friendly.

Although the prevalence of photochemical smog in metropolitan areas spurred the first public interest in reducing noxious emissions from exhaust emissions, reducing output of all types of harmful emissions, including carbon monoxide (CO), hydrocarbons (HC) and nitrous oxides (NOx) has become one of the goals of the diesel engine industry. Through the years, the diesel engine industry has greatly reduced the smoke, carbon monoxide and hydrocarbons emitted into the atmosphere. However, it is the nitrous oxides and particulate emissions that remain one of the plaguing problems for diesel engines.

In order to reduce the amount of nitrogen oxides emitted, the injector should create less heat in the combustion chamber. One method to create less heat, and thereby produce less nitrogen oxides, is by retarding the injection timing of the fuel injectors. By retarding the timing of diesel fuel injections, the combustion process occurs at a later time in the power stroke. By retarding the timing, the combustion temperature and pressure are lowered, thereby causing less nitrogen oxides to form. The amount of nitrogen oxide lessens with higher levels of retard.

The drive linkage (which includes the associated engine cam, a rocker arm assembly, a socket pad on the head of the adjusting screw and a spring-loaded tappet or follower carried by the injector pad and slidably engaged by the pad) powers the injector pump to actuate the injector plunger as determined by the engine cam profile. One possible method for retarding timing is by adjusting the screw on the output end of the engine rocker arm. As the adjusting screw is turned, the free length of the adjusting screw below the output end of the rocker arm is changed and creates a new set screw set point. As a result, the drive linkage is either shortened or lengthened until there is a predetermine specified timing distance between the top face of the follower and a fixed surface, namely the top flat face of the injector body. The specified timing distance is the distance that is obtained when the port closure of the helix of the plunger is above the point at which it will close off its associated spill port in the plunger bushing to thereby initiate injection, which is known as its set point. The set point is usually listed on the engine manufacturer's data plate. If the set point listed on the data plate does not match with the set point for the now retarded injector, a new setting gauge and new engine marking must be provided.

In addition, the new timing distance specification or adjusting screw set point prescribed to retard injection timing may vary from engine model to engine model. This variation creates a potential for human error wherein a mechanic must use multiple gages to set multiple engines.

Thus, a need exists for methods of retarding injection timing of mechanical unit injectors that are simple and minimizes human error in reducing undesirable emissions.

The relevant prior art includes the following references:

| Patent No. (U.S. unless stated otherwise) | Inventor | Issue/Publication Date |
|---|---|---|
| 6,321,723 | Merkle et al. | Nov. 27, 2001 |
| 6,763,810 | Jones | Jul. 20, 2004 |
| 3,982,693 | Hulsing | Sep. 28, 1976 |
| 4,984,738 | Winquist | Jan. 15, 1991 |
| 4,317,541 | Beardmore | Mar. 02, 1982 |
| 4,054,248 | Beardmore | Oct. 18, 1977 |
| 2,898,051 | Teichert | Aug. 04, 1959 |
| 4,213,564 | Hulsing | Jul. 22, 1980 |
| 5,328,094 | Goetzke et al. | Jul. 12, 1994 |
| 6,439,204 | Duquette | Aug. 27, 2002 |

SUMMARY OF THE INVENTION

The primary object of the present invention is to provide a method of retarding injection timing of mechanical unit injectors which reduces the amount of nitrogen oxides emitted from a diesel engine.

A further object of the present invention is to provide a method of retarding injection timing of mechanical unit injectors that does not require specifying a new timing distance.

An even further object of the present invention is to provide a method of retarding injection timing of mechanical unit injectors that does not require the providing of a new setting gauge and/or new engine marking.

Another object of the present invention is to provide a method of retarding injection timing of mechanical unit injectors that could be used on all diesel engines.

The present invention fulfills the above and other objects by providing a method of retarding injection timing of mechanical unit injectors wherein a modified pump follower is used. The modified pump follower includes a plunger engagement location, also known as a t-slot, whose location of the t-slot differs in comparison to conventional t-slot locations. The modified pump follower t-slot is located at a predetermined distance closer to the top face of the pump follower t' as compared to conventional pump followers having a predetermined t-slot to top face of the pump follower t distance. The difference in spacing between the original timing t and the retarded timing t' is r, which is an amount equal to the amount of retardation, in linear units, that corresponds to the desired amount of retardation in crank degrees.

A second embodiment of the present invention also includes a method of retarding injection timing of mechanical unit injectors wherein a modified pump follower is used. The modified pump in the second embodiment includes a modified top face wherein the thickness of the top face differs in comparison to the thickness of the convention top face of the pump follower. The top face of the pump follower in the second embodiment of the present invention is located at a predetermined distance closer to the t-slot location of the pump follower t' as compared to conventional pump followers having a predetermined t-slot to top face of the pump follower t distance. The difference in spacing between the original timing t and the retarded timing t' is r, which is an amount equal to the amount of retardation, in linear units, that corresponds to the desired amount of retardation in crank degrees.

Therefore, the amount r may be obtained by moving the t-slot, as described in the first embodiment of the present invention, by removing material from the top face, as described in the second embodiment of the present invention, or by utilizing a combination of both embodiments.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
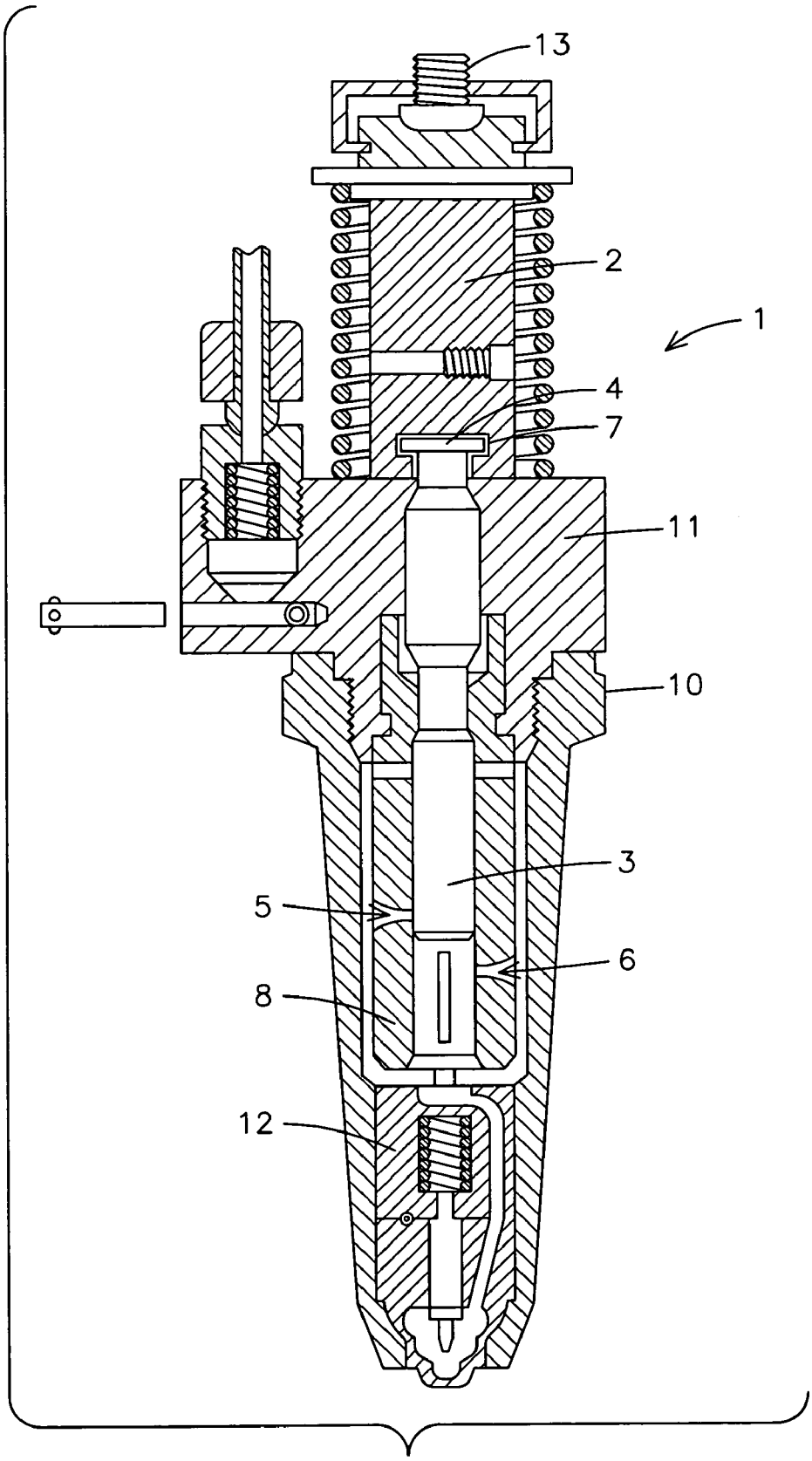
FIG. 1 is a cut-away side view of a fuel injector of the present invention.

For purposes of describing the preferred embodiment, the terminology used in reference to the numbered components in the drawings is as follows:

1. fuel injector, generally
2. pump follower
3. pump plunger
4. plunger head
5. top port
6. bottom port
7. t-slot
8. pump barrel
9. top face of pump follower
10. valve nut
11. body
12. cylinder
13. adjusting screw
14. top face of t-slot
15. t-slot arms With reference to FIG. 1, a cut-away side view of a fuel injector of the present invention is shown. The fuel injector 1 includes a body 11 of a conventional unit injector. A valve nut 10 holds the pump barrel 8 to the body 11. A pump plunger 3 having a plunger head 4 is slidably received within the pump barrel 8. A modified pump follower 2 of the present invention having a t-slot 7 receives a plunger head 4 of the pump plunger 3. Thus, the pump plunger 3 and pump follower 2 are in end-to-end arrangement and move as one unit when in use. The pump barrel 8 includes a top port 5 and a bottom port 6 for the admittance and remittance of fuel. An adjusting screw 13 is located on a flat top surface of the pump follower 2.

Figure 2:
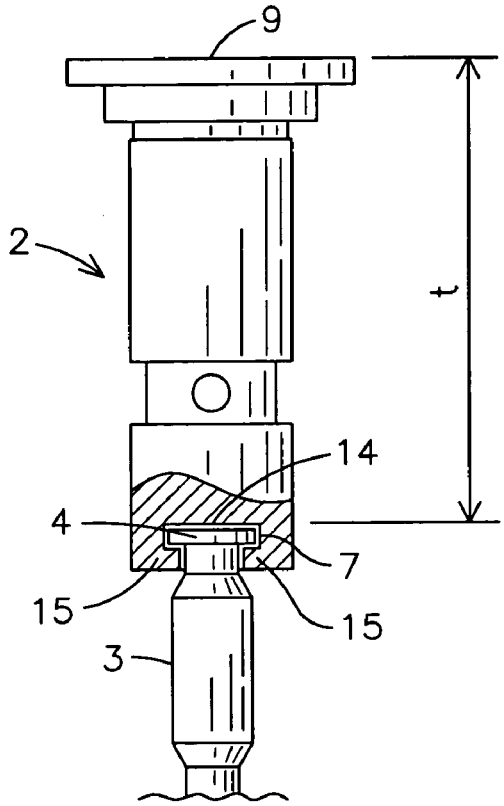
FIG. 2 is a partial cut-away view of a conventional pump follower.

In FIG. 2, a partial cut-away view of a conventional pump follower is shown. The distance between a top face of the pump follower 9 to a top face of a t-slot 14 is a predetermined distance, t. The plunger head 4 of the pump plunger 3 is inserted into the t-slot 7 such that t-slot arms 15 substantially wrap around the pump plunger 3. In this manner, the pump follower 2 and the pump plunger 3 move as one unit during use.

Figure 3:
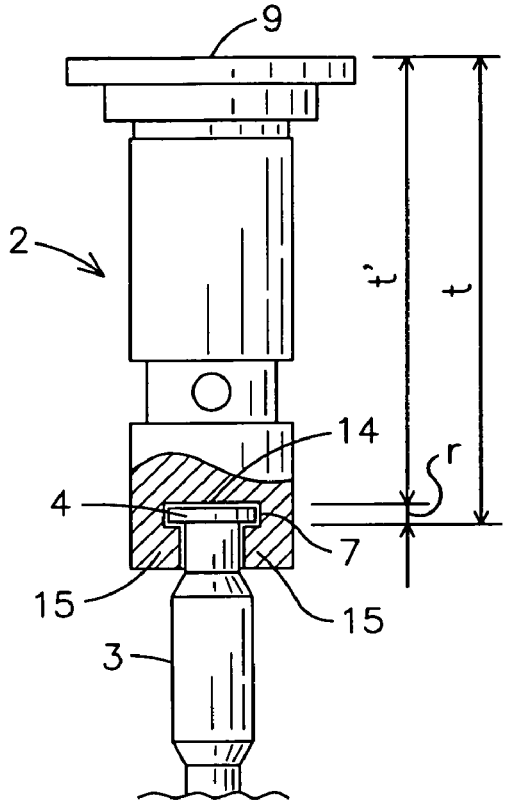
FIG. 3 is a partial cut-away view of a modified pump follower of a first embodiment of the present invention indicative of a method of retarding injection timing of the present invention.

Next, FIG. 3 shows a partial cut-away view of a modified pump follower of the present invention indicative of a method of retarding injection timing of the present invention. The original distance between the top face of the pump follower 9 and the top face of the t-slot 14 is t. However, the present invention utilizes a modified pump follower 2 wherein a predetermined distance between the top face of the pump follower 9 and the top face of the t-slot 14 is t'. The difference between the predetermined distance of the modified pump follower 2 (t') and the original distance (t) is the amount of retardation, r. The amount of retardation r, which is expressed in linear units, corresponds to the desired amount of retardation in crank degrees. Although the original distance t is reduced when retarding the injection timing using the present invention to t', because the spacing differential r only changes the dimensions of the injector 1, there is no need to specify a new timing distance or provide a new setting gauge and/or new engine marking.

Figure 4:
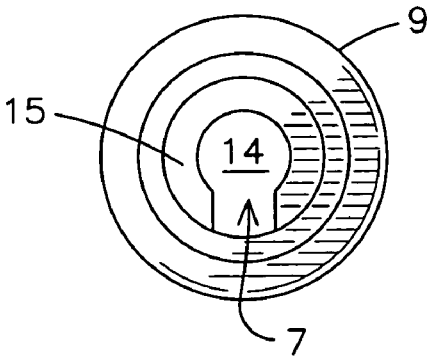
FIG. 4 is an upward looking view of a modified pump follower of a first embodiment of the present invention.

FIG. 4 shows an upward looking view of a modified pump follower of the present invention. The t-slot arms 15 form a C-shape so as to create an opening in the t-slot 7 for the acceptance of a pump plunger 3.

Figure 5:
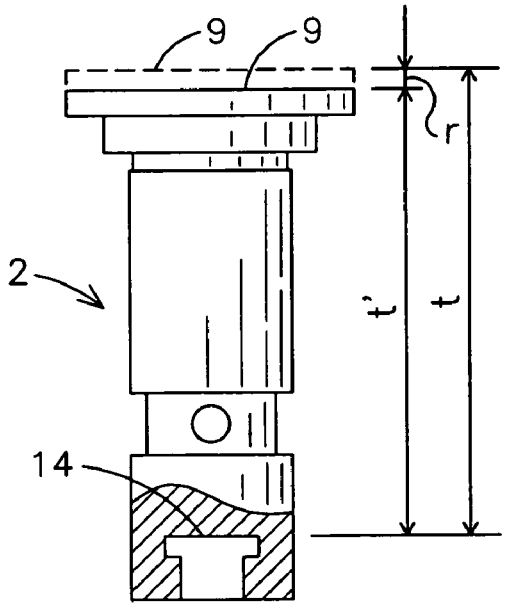
FIG. 5 is a partial cut-away view of a modified pump follower of a second embodiment of the present invention indicative of a method of retarding injection timing of the present invention.

Finally, FIG. 5 shows a partial cut-away view of a modified pump follower of a second embodiment of the present invention indicative of a method of retarding injection timing of the present invention is shown wherein the original distance between the top face of the pump follower 9 and the top face of the t-slot 14 is t as shown in FIG. 2 and FIG. 5. The second embodiment of the present invention also utilizes a modified pump follower 2 wherein a predetermined distance between the top face of the pump follower 9 and the top face of the t-slot 14 is t'. The difference between the predetermined distance of the modified pump follower 2 (t') and the original distance (t) is also the amount of retardation, r. The amount of retardation r, which is expressed in linear units, corresponds to the desired amount of retardation in crank degrees.

Thus, rather than the amount of retardation, r, being determined via moving the top face of the t-slot 14 as in the first embodiment of the present invention as shown in FIG. 3, the second embodiment utilizes a modified pump follower 2 wherein the vertical thickness of the top face of the pump follower 9 is reduced as shown in FIG. 5. The reduction may be obtained by shaving the top face of the pump follower 9 or by any other means. Therefore, although the original distance t is reduced when retarding the injection timing using the present invention to t', because the spacing differential r only changes the dimensions of the injector 1, there is no need to specify a new timing distance or provide a new setting gauge and/or new engine marking.

The use of the present invention will permit a person to easily retard the injection timing of EMD-type unit injectors without specifying a new timing distance or providing a new setting gauge and/or new engine marking.

In addition, although the use of the present invention is described with respect to EMD-type unit injectors in diesel engines, the present invention could also be used in conjunction with all types of diesel engines, such as semi-trucks, marine vehicles, off-highway and on-highway vehicles, etc.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A method of providing an injector to be used in a given model of an engine and having its injection timing retarded by a given amount r, expressed in lineal units, as compared to a reference injector with unretarded timing and previously used in said given model, said method comprising the steps of:

a. determining a distance t from a top face of a pump follower of said given model to a top face of a t-slot of said given model;

b. providing a modified pump follower having a predetermined distance t' as measured from a top face of said modified pump follower to a top face of a t-slot wherein a difference between said t distance and said t' distance is r; and c. assembling said modified pump follower into an injector assembly.

2. The method of claim 1 wherein:

said modified pump follower is obtained by moving said top face of a t-slot of said given model a predetermined amount r.

3. The method of claim 1 wherein:

said modified pump follower is obtained by reducing said top face of a pump follower of said given model a predetermined amount r.

4. The method of claim 1 wherein:

said modified pump follower is obtained by moving said top face of a t-slot of said given model a predetermined amount r; and said modified pump follower is obtained by reducing said top face of a pump follower of said given model a predetermined amount r.

5. A modified pump follower to be used in a given model of an engine and having its injection timing retarded by a given amount r, expressed in lineal units, as compared to a reference injector with unretarded timing and previously used in said given model, said given model having a distance t measured from a top face of a pump follower to a top face of a t-slot, said modified pump follower comprising:

a top face; and a t-slot having a top face wherein said t-slot is located at a predetermined t' from said top face of said modified pump follower to said top face of said t-slot of said modified pump follower wherein said predetermined distance t' plus said given amount r equals said distance t.

6. The modified pump follower of claim 5 wherein:

said modified pump follower is obtained by moving said top face of a t-slot of said given model a predetermined amount r.

7. The modified pump follower of claim 5 wherein:

said modified pump follower is obtained by reducing said top face of a pump follower of said given model a predetermined amount r.

8. The modified pump follower of claim 5 wherein:

said modified pump follower is obtained by moving said top face of a t-slot of said given model a predetermined amount r; and said modified pump follower is obtained by reducing said top face of a pump follower of said given model a predetermined amount r.

* * * * *